United States Patent [19]

Thornton

[11] 4,315,193

[45] Feb. 9, 1982

[54] HIGH-PRESSURE MERCURY-VAPOR LAMP WHICH HAS BOTH IMPROVED COLOR RENDITION AND LIGHT OUTPUT

[75] Inventor: William A. Thornton, Cranford, N.J.

[73] Assignee: Westinghouse Electric Corp., Pittsburgh, Pa.

[21] Appl. No.: 131,305

[22] Filed: Mar. 18, 1980

[51] Int. Cl.[3] ..... H01J 61/44

[52] U.S. Cl. ..... 313/487; 313/184

[58] Field of Search ..... 313/25, 184, 227, 487

[56] References Cited

U.S. PATENT DOCUMENTS

| | | | |
|---|---|---|---|
| 3,602,758 | 8/1971 | Thornton | 313/184 X |
| 3,630,946 | 12/1971 | Ropp et al. | 252/301.4 R |
| 3,937,998 | 2/1976 | Verstegen et al. | 313/487 |
| 4,038,204 | 7/1977 | Wachtel | 252/301.4 P |
| 4,065,688 | 12/1977 | Thornton | 313/25 |

FOREIGN PATENT DOCUMENTS

| | | | |
|---|---|---|---|
| 51-4883 | 1/1976 | Japan | 313/487 |

OTHER PUBLICATIONS

Nathan Sohn, Fluorescence Properties of Alkaline Earth Tellurates, Journal of the Electrochemical Society 120(5), pp. 660–664, 1973.

*Primary Examiner*—Eugene R. La Roche
*Attorney, Agent, or Firm*—W. D. Palmer

[57] ABSTRACT

High-pressure mercury-vapor lamp incorporates a special phosphor mixture on the interior surface of the outer envelope. The phosphor mixture comprises predetermined proportions and predetermined amounts of blue-violet-emitting phosphor, blue-green-emitting phosphor and red-emitting phosphor. When the composite emission of the phosphor mixture is combined with the visible light generated by the high-pressure mercury discharge, both the color rendering index and the light output of the lamp are substantially improved.

4 Claims, 5 Drawing Figures

HIGH-PRESSURE MERCURY-VAPOR LAMP WHICH HAS BOTH IMPROVED COLOR RENDITION AND LIGHT OUTPUT

BACKGROUND OF THE INVENTION

This invention relates to high-pressure mercury-vapor lamps and, mor particularly, to such a lamp which incorporates a special phosphor mixture as a coating on the interior surface of the outer envelope in order to improve both the color rendition and light output of the lamp.

High-pressure mercury-vapor lamps which have a light emission modified by the use of phosphor mixtures are well known and one embodiment of such a lamp is described in U.S. Pat. No. 4,065,688, dated Dec. 27, 1977 to W. A. Thornton, the present applicant. The phosphors utilized include red-emitting yttrium vanadate or yttrium phosphate vanadate activated by trivalent europium. Another embodiment of such a lamp is described in U.S. Pat. No. 3,602,758 dated Aug. 31, 1971 to Thornton et al.

Apatite-structured strontium chlorophosphate activated by a divalent europium is a well-known narrow-band, blue-emitting phosphor and is disclosed in U.S. Pat. No. 4,038,204, dated Jul. 26, 1977 to Wachtel. Other such blue-violet emitting phosphors activated by divalent europium are known and are described in U.S. Pat. No. 3,937,998, dated Feb. 10, 1976 to Verstegen et al.

Calcium orthotellurate activated by uranium is a known phosphor which has a narrow emission in the blue-green peaking at about 500 nm. This phosphor is described in detail in Journal of Electrochemical Society, Volume 120, pgs. 660–664 (1973).

A method for preparing red-emitting yttrium vanadate phosphor activated by trivalent europium is disclosed in U.S. Pat. No. 3,630,946 dated Dec. 28, 1971 to Ropp, et al. and such phosphor is now well known.

The internationally accepted method for standardizing and measuring the color rendering properties of light sources is set forth in the publication of the International Commission on Illumination, identified as publication C.I.E. No. 13, (E-1.3.2.) 1965.

SUMMARY OF THE INVENTION

There is provided a high-pressure mercury-vapor lamp having both improved lumen output and color rendering properties for illuminated objects. The lamp comprises a sealed elongated radiation-transmitting arc tube having electrodes operatively disposed therein proximate the ends thereof and enclosing a discharge-sustaining filling comprising a predetermined amount of mercury and a small charge of inert ionizable starting gas. The arc tube is mounted in a sealed light-transmitting protective vitreous envelope with the environment enclosed by the protective envelope being non-reactive for the lamp elements enclosed thereby. Electrical lead-in means are sealed through the arc tube and connect to the electrodes and electrical adaptor means is affixed to the outer surface of the protective envelope to facilitate electrical connection to a source of electrical power. Electrical conductor means serve to electrically connect the electrical adaptor means to the lead-in means. During operation of such a lamp, the radiations emitted by the operating arc tube principally comprise a very strong green emission and a very strong yellow emission along with a strong violet emission, in addition to both short wavelength and long wavelength ultraviolet emissions.

In accordance with the present invention, a finely divided, specially blended phosphor means is carried ried as a coating on the inner surface of the protective envelope. This phosphor means is responsive to the ultraviolet radiations generated by the operating arc tube in order to provide a predetermined visible emission. The phosphor means principally comprises predetermined proportions and predetermined amounts of three different phosphor components. A first of the phosphor components is divalent-europium-activated phosphor which has a narrow-band blue-violet visible emission peaked at about 450 nm. A second of the phosphor components has a narrow-band blue-green visible emission peaked at about 500 nm. The third of the phosphor components is trivalent-europium-activated phosphor having a strong red emission located at about 620 nm. Relative proportions and predetermined amounts of the three phosphor components are so selected that when their individual visible emissions are blended with the visible emissions from the operating arc tube, the composite emission from the lamp has a predetermined color temperature. Preferably, the phosphor blend is compounded that the lamp has a cool-white color temperature of about 4100° K.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
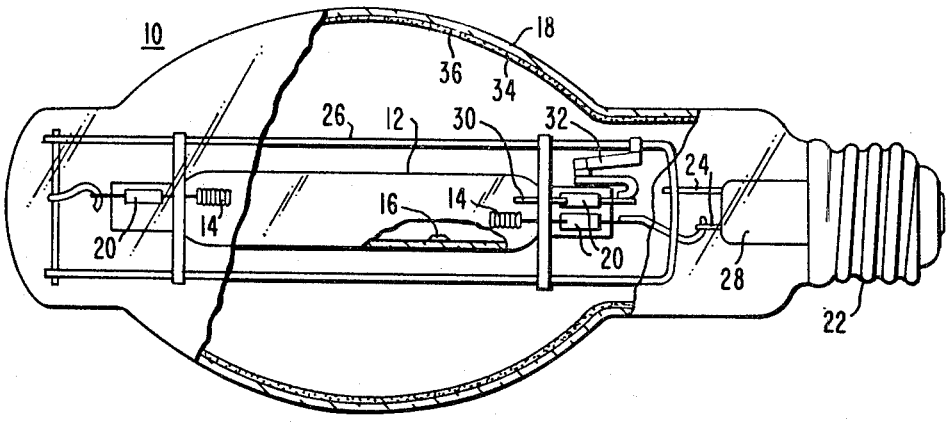
FIG. 1 is an elevational view, shown partly in section, illustrating a high-pressure mercury-vapor lamp fabricated in accordance with the present invention.

With specific reference to the form of the invention illustrated in the drawings, the high-pressure mercury-vapor lamp 10 as shown in FIG. 1 is designed to operate with a power input of 400 watts and comprises a sealed, elongated, radiation-transmitting arc tube 12 which is fabricated of quartz having electrodes 14 operatively disposed therein proximate the ends thereof and enclosing a discharge-sustaining filling comprising a predetermined amount of mercury 16 such as 60 mg and a small charge of inert, ionizable starting gas such as twenty torrs of argon. The arc tube 12 is operatively mounted in a sealed, light-transmitting, protective vitreous envelope 18 and the environment enclosed by the envelope 18 is non-reactive for the lamp elements which are enclosed thereby, an example being a nitrogen atmosphere. Electrical lead-in means 20 are sealed through the arc tube and connect to the electrodes and the lead-in means include conventional molybdenum ribbon seals which are used to provide the hermetic seal. An electrical adaptor means such as a conventional screw type base 22 is affixed to the outer surface of the protective envelope 18 to facilitate electrical connection to a source of power. Electrical conductor means 24 connect the base 22 to the electrical lead-in means 20. The complete the description, the arc tube is supported by a conventional frame 26 which forms a part of the electrical conductor means which are sealed for passage through the protective outer envelope 18 by means of a conventional stem press 28. The arc tube is provided with a conventional starting electrode 30 which connects through a resistor 32 to the oppositely disposed electrode 14. When the lamp is operated, all of the mercury 16 is vaporized and the high-pressure mercury-vapor discharge provides radiations which principally comprise a very strong green emission, a very strong yellow emission, a strong violet emission, and both short wavelength and long wavelength ultraviolet emissions.

In accordance with the present invention, a layer 34 of special phosphor means is coated on the interior surface 36 of the outer envelope 18. This phosphor means layer 34 is responsive to the ultraviolet radiations generated by the operating arc tube to provide a predetermined visible emission. The phosphor means principally comprises predetermined proportions and predetermined amounts of three different phosphor components. A first of the phosphor components is divalent-europium-activated phosphor having a narrow band, blue-violet visible emission peaked at about 450 nm. A second of the phosphor components has a narrow band, blue-green visible emission peaked in the vicinity of about 500 nm. The third of the phosphor components is trivalent-europium-activated phosphor having a strong red emission located at about 620 nm. The relative proportions and predetermined amounts of the three phosphor components are such that when their individual visible emissions are blended with the visible emissions from the operating arc tube, the composite emission from the operating lamp has a predetermined color temperature.

The preferred blue-violet-emitting phosphor is apatite-structured strontium chlorophosphate activated by divalent europium and such a phosphor is described in detail in the aforementioned U.S. Pat. No. 4,038,204. The preferred blud-green emitting phosphor is calcium orthotellurate activated by uranium and this phosphor is described in detail in the aforementioned Journal of the Electrochemical Society article. The preferred red-emitting phosphor is yttrium vanadate activated by trivalent europium and such a phosphor is described in detail in the aforementioned U.S. Pat. No. 3,630,946. In order to provide a 400 watt high-pressure mercury vapor lamp with a composite cool white color temperature of about 4100° K., the blue-violet-emitting phosphor, the blue-green-emitting phosphor and the red-emitting phosphor are mixed in respective weight ratios of about 1:5:10 and the mixed finely-divided materials are coated as a layer 34 unto the interior surface 36 of the outer envelope 18 as shown in FIG. 1, using either a liquid coating technique or a dry electrostatic precipitation technique, and such coating processes are well known. As a specific example, the phosphor layer 34 is coated to a total weight of 2–3 mg/cm$^2$.

Figure 2:
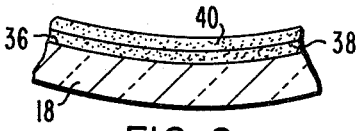
FIG. 2 is an expanded fragmentary view of a portion of the outer envelope which has coated on the interior surface thereof a double layer of mixed phosphor specially selected in accordance with the present invention.

In FIG. 2 is shown an alternative embodiment wherein the blend of phosphor is coated as a double layer onto the interior surface 36 of the outer envelope 18. As a specific example, the phosphor layer 38 which is positioned next to the envelope is a blend of the aforementioned strontium chlorophosphate and the calcium orthotellurate. Coated thereover is a spearate layer 40 of the europium-activated yttrium vanadate which is a more expensive component. By coating the expensive phosphor so that it is positioned nearest to the energizing ultraviolet radiations, less of the expensive material is required and such a double coating technique is well known in the art as described in aforementioned U.S. Pat. No. 3,602,758.

Figure 3:
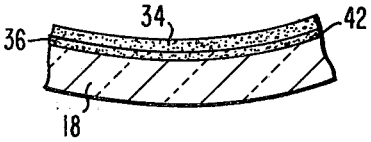
FIG. 3 is a fragmentary expanded view of a portion of the outer envelope which has coated on the interior surface thereof the present selected mixed phosphors with an underlying layer of light-scattering material such as silica.

Another alternative embodiment is shown in FIG. 3 wherein a layer 42 of light-scattering material such as silica is first coated onto the interior surface 36 of the outer envelope 18 and the phosphor blend 34 coated thereover. In this manner, ultraviolet radiations which may escape absorption by the phosphor layer 34 are scattered back by the silica layer 42 to energize the phosphor.

Figure 4:
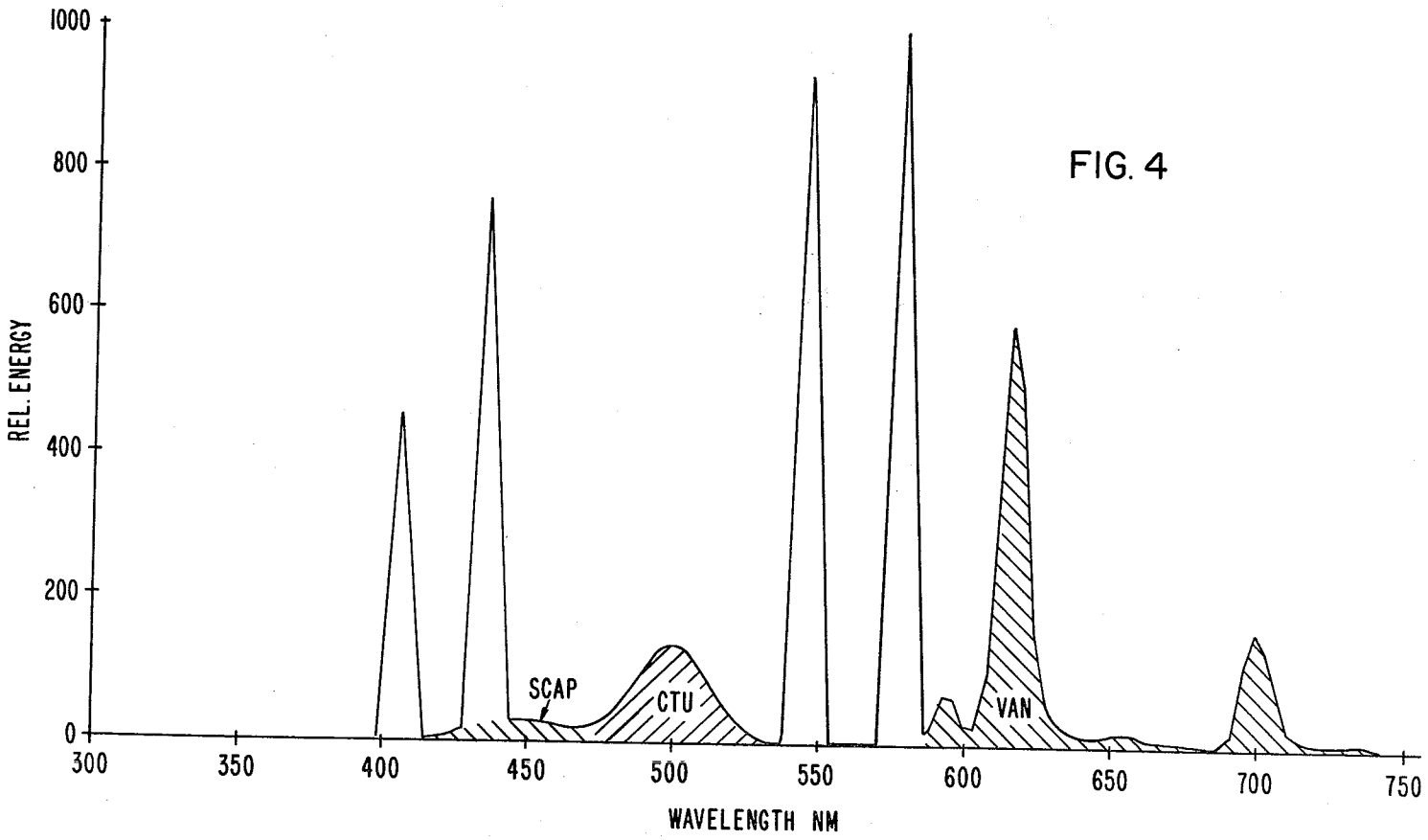
FIG. 4 is a graph of relative energy versus wavelength showing the composite spectral power distribution for a high-pressure mercury-vapor lamp of the present invention.

In FIG. 4 is shown the composite emission for the 400 watt lamp embodiment as previously described. The visible emissions from the arc are shown as unhatched peaks and the emissions from the composite phosphor are shown in hatched form. The emission from the strontium chloroapatite is abbreviated as SCAP, the emission from the calcium tellurate is abbreviated as CTU, and the emission from the yttrium vanadate is abbreviated as VAN.

Figure 5:
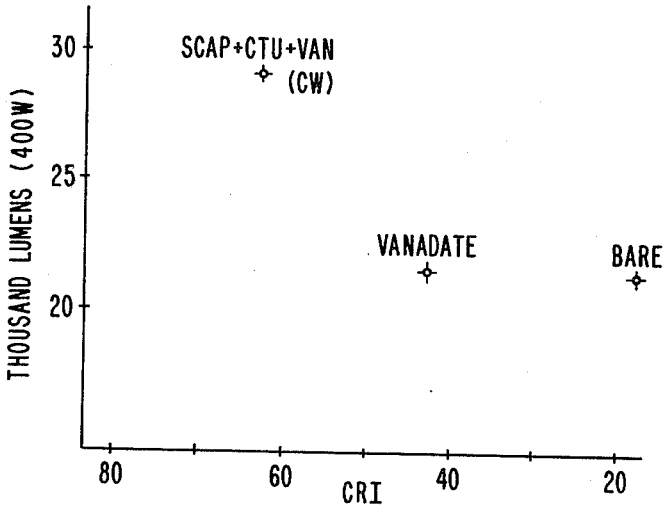
FIG. 5 is a plot of lumens versus color rendering index showing the improved light output and color rendering index which is obtained for a lamp of the present invention.

The performance for such a 400 watt lamp is shown in FIG. 5 wherein lumens are plotted versus color rendering index. A bare 400 watt mercury vapor lamp provides about 21,000 lumens with a color rendering index of 20 and appears to the eye to have a greenish-yellow color. Addition of only europium-activated yttrium vanadate phosphor as a layer on the outer envelope improves the color rendering index to about 43, with the lamp lumen output remaining at about 21,000. In accordance with the present invention, if the emissions from the blue-violet phosphor, the blue-green phosphor and the red-emitting phosphor are blended with the visible emissions from the mercury discharge, the lumen output of the lamp can be increased to 29,000 with a color rendering index of 63, as graphically illustrated in FIG. 5. This performance is obtained for a lamp having a composite cool white color which represents a color temperature of approximately 4100° K.

Other blue-violet-emitting phosphors can be substituted for the preferred strontium chloroapatite and such other phosphors are disclosed in the aforementioned U.S. Pat. No. 3,937,998, such as barium magnesium aluminate activated by a divalent europium. In addition, other red-emitting phosphors can be substituted for the preferred yttrium vanadate, an example being yttrium phosphate vanadate activated by trivalent europium.

Other narrow-band, blue-green-emitting phosphors can be substituted for the specified uranium-activated calcium orthotellurate. Specific examples are barium magnesium aluminate activated by divalent europium and manganese which has an emission peak at about 510 nm, yttrium vanadate activated by thulium which has an emission peak at about 480 nm, and strontium borophosphate activated by divalent europium which has an emission peak at about 510 nm. Other suitable blue-green-emitting phosphors are lanthanum oxysulfide activated by praseodymium, and manganese-activated zinc gallate ($ZnGa_2O_4$):Mn which has an emission peak at about 506 nm. All of these are known phosphors.

The color temperature of the composite lamp emission can be controlled by varying the relative proportions of the three-component phosphor blend. As a general rule, the weight ratio of the blue-violet-emitting phosphor to total phosphor in the blend should be from 0.03 to 0.15, the weight ratio of the blue-green-emitting phosphor to total phosphor in the blend should be from 0.15 to 0.5, and the weight ratio of the red-emitting phosphor to total phosphor in the blend should be from 0.5 to 0.9.

I claim:

1. A high-pressure mercury-vapor lamp having both improved lumen output and color rendering properties for illuminated objects, said lamp comprising a sealed elongated radiation-transmitting arc tube having electrodes operatively disposed therein proximate the ends thereof and enclosing a discharge-sustaining filling comprising a predetermined amount of mercury and a small charge of inert ionizable starting gas, a sealed light-transmitting protective envelope in which said arc tube is operatively mounted with the environment enclosed by said protective envelope being non-reactive for the lamp elements enclosed thereby, electrical lead-in means sealed through said arc tube and connecting to said electrodes, electrical adapter means affixed to the outer surface of said protective envelope to facilitate electrical connection to a source of electrical power, and electrical conductor means electrically connecting said electrical adaptor means to said electrical lead-in means, the radiations emitted from said arc tube when operated principally comprising a very strong green emission and a very strong yellow emission and a strong violet emission in addition to both short wavelength and long wavelength ultraviolet emissions;

finely divided phosphor means carried as a coating on the inner surface of said protective envelope, said phosphor means responsive to the ultraviolet radiations generated by said operating arc tube to provide a predetermined visible emission, said phosphor means principally comprising predetermined proportions and predetermined amounts of three different phosphor components, a first of said phosphor components being divalent-europium activated phosphor having a narrow band blue-violet visible emission peaked at about 450 nm;

a second of said phosphor components having a narrow-band blue-green visible emission peaked in the vicinity of about 500 nm, and the third of said phosphor components being trivalent-europium-activated phosphor having a strong red emission located at about 620 nm; and the relative proportions and predetermined amounts of said three phosphor components being such that when their individual visible emissions are blended with the visible emissions from said operating arc tube, the composite emission from said lamp has a predetermined color temperature.

2. The lamp as specified in claim 1, wherein said blue-violet-emitting phosphor is apatite-structured strontium chlorophosphate activated by divalent europium, said blue-green-emitting phosphor is calcium orthotellurate activated by uranium, and said red-emitting phosphor is yttrium vanadate activated by trivalent europium.

3. The lamp as specified in claim 1, wherein the weight ratio of said blue-violet-emitting phosphor to total phosphor means is from 0.03 to 0.15, the weight ratio of said blue-green-emitting phosphor to total phosphor means is from 0.15 to 0.5, and the weight ratio of said red-emitting phosphor to total phosphor means is from 0.5 to 0.9.

4. The lamp as specified in claim 3, wherein the respective weight ratios of said blue-violet-emitting phosphor, said blue-green-emitting phosphor, and said red-emitting phosphor are about 1:5:10, and the composite emission from said lamp has a color temperature of about 4100° K.

* * * * *